United States Patent [19]

Zatlin

[11] Patent Number: 4,887,824

[45] Date of Patent: Dec. 19, 1989

[54] SKATECRAFT

[76] Inventor: Jeffrey Zatlin, 1115 Fifth St., Santa Monica, Calif. 90403

[21] Appl. No.: 52,286

[22] Filed: Aug. 24, 1987

[51] Int. Cl.[4] ..... A63C 17/01

[52] U.S. Cl. ..... 280/87.042; 16/35 D

[58] Field of Search ..... 280/87.04 A, 87.04 R, 280/11.1 BT, 89, 87.041, 87.042, 842; 16/35 D, 35 R

[56] References Cited

U.S. PATENT DOCUMENTS

| | | | |
|---|---|---|---|
| 3,399,904 | 9/1968 | Schinke | 280/87.04 A |
| 3,684,305 | 8/1972 | McDonald et al. | 280/87.04 A X |
| 4,054,965 | 10/1977 | Vig et al. | 16/35 D |
| 4,095,817 | 6/1978 | Cohen | 280/87.04 A |
| 4,196,916 | 4/1980 | Schorr | 280/87.04 A |
| 4,295,656 | 10/1981 | Moore | 280/87.04 A |
| 4,323,261 | 4/1982 | Samuelson | 280/87.04 A |
| 4,744,576 | 5/1988 | Scollan, Jr. | 280/87.04 A |

FOREIGN PATENT DOCUMENTS

| | | | |
|---|---|---|---|
| 1215053 | 4/1960 | France | 280/87.04 A |

*Primary Examiner*—Charles A. Marmor
*Assistant Examiner*—Tamara L. Finlay

[57] ABSTRACT

A skatecraft is shown having three planes with two wheels mounted on the central plane and one wheel each mounted on each outboard planes. The wheels on the outboard planes are provided with a magnetically oriented wheel mount that will permit the mounted wheel to swivel when in contact with the ground, but will return the wheel to an aligned position when contact is removed.

4 Claims, 1 Drawing Sheet

SKATECRAFT

BACKGROUND OF THE INVENTION

1. Field of the Invention

The present invention relates to skateboarding, whether for sport or recreation.

2. Description of the Prior Art

Wheels mounted to opposite ends of a singular planar surface to form a skateboard have been around for many years. Various skateboards have been designed for trick riding, including variations of where and how the skateboard wheels are mounted to the board. However, none of the skateboards known incorporate the unique mounting arrangement of the present invention.

SUMMARY OF THE INVENTION

The present invention relates to a skateboard having more than one plane. Mounted upon the several planes are a plurality of wheels, at least two of which support the main plane, through contact with a surface with less than the full number of wheels contacting the surface at one time. The wheels which do not normally contact the surface are provided with a mounting devise which is free to swivel once the wheel that normally does not contact the surface comes into contact therewith. When such contact is removed, the normally free wheel automatically returns to its previous alignment.

DESCRIPTION OF THE PREFERRED EMBODIMENT

Figure 1:
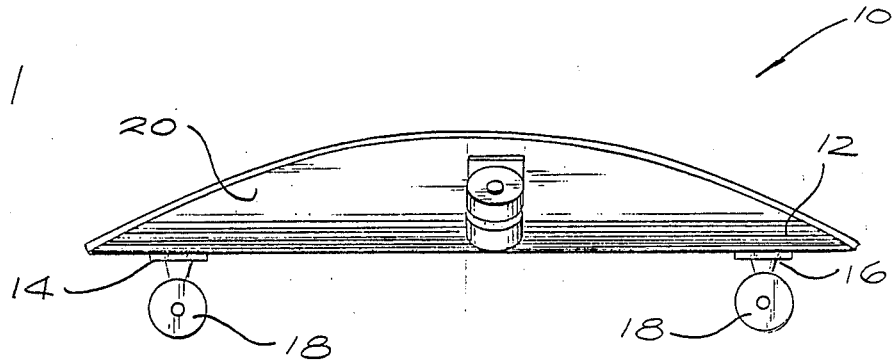
FIG. 1 is a side view of a skateboard incorporating the present invention.

Referring to FIG. 1, a skateboard is shown generally at 10 having a first plane 12 mounting a pair of wheel mounts 14 and 16 to which are attached skateboard wheels 18 such as a typical wheel used on most skateboards of the prior art. That is, a weight shift by the user upon the platform formed by the skateboard 10 will cause the skateboard to tilt and the wheels 18 on mounts 14 and 16 to turn the skateboard in a curving pattern in the direction of the weight shift or tilt, as is well-known.

Figure 2:
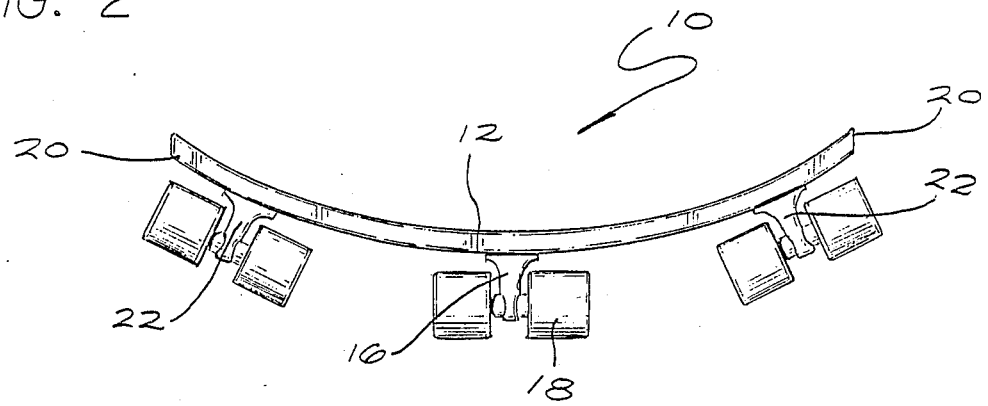
FIG. 2 is an end view of the skateboard of FIG. 1.
Figure 3:
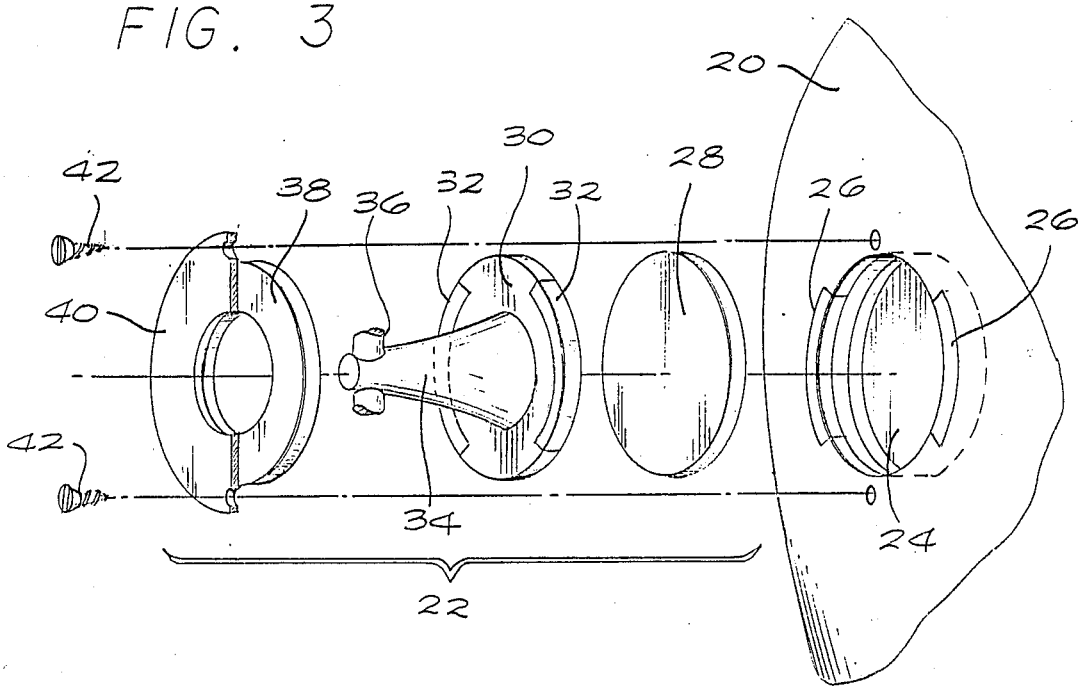
FIG. 3 is an exploded view of one of the wheel mounts used on the skateboard of FIGS. 1 and 2.

Extending from the first plane 12 are a pair or side plane members 20 also seen in FIG. 2. Mounted on each side of plane member 20 is a specially adapted wheel mount 22 as shown in FIG. 3. Wheel mounts 22 mount additional skateboard wheels 18.

As seen in FIG. 3, the wheel mount 22 consists of a plurality of parts including a skateboard platform mounting member 24 which is mounted directly to the platform 20 having a pair of magnets 26 mounted on the periphery thereof. A weight bearing metal washer 28 fits between the magnets 26 within the platform mount 24 to support the weight of a wheel mounting disk 30 having a second pair of magnets 32 embedded within its periphery. The reader will understand that the magnets 32 will align with magnets 26 once the wheel mount 22 is assembled so that magnets 32 are repelled by magnets 26 to orient a post 34 in the desired relationship. Passing through an aperture within post 34 is an axle 36 which mounts the skateboard wheels 18. The assembly is completed by an insert washer 38 which fits about the wheel mounting disks 30 and which is retained by a cap 40 through which suitable fastening devices, such as screws 42, may be passed.

In operation, the wheels 18 on mounting posts 22 are normally aligned with the wheels 18 on the mounts 14 and 16 by the repulsion of magnets 32 interacting with magnets 26 so that the axle 36 is generally perpendicular to the center line of the skateboard platform 12. Ball bearings, not shown, may be utilized to support the weight of the user of the skateboard when the user positions his weight so as to lower one of the skateboard wheels 18 mounted upon wheel mount 22 into contact with the pavement. As contact is initiated by a weight shift, the user will bring one outer skateboard wheel 18 mounted on the specially designed wheel mount 22 into initial contact with the pavement. As contact is initiated, the weight of the user will overcome the repulsion of magnets 32 and 26 to quickly align the newly contacting wheel specially mounted on wheel mount 22 with the direction of travel of the skateboard 10. Further weight shift will place the majority of the user's weight upon the one contacting, specially mounted, wheel to permit the user to quickly turn or spin thereon; while the two wheels 18 mounted on standard mounts 14 and 16 are lifted from the pavement or are only in slight contact therewith.

When the user's weight is shifted back toward the center of the skateboard, to remove one outer skateboard wheel from the surface of the pavement, the repulsion of magnets 32 interacting with magnets 36 will rotate wheel mounting disk 30 riding on the ball bearings, not shown, back to the desired orientation, as shown in FIGS. 1 and 2.

I claim:

1. In a skateboard for use on a surface formed by mounting a plurality of wheels upon a platform, wherein the improvements comprises:

said platform is formed from a single, integral body in more than one plane;

said plurality of wheels each having an axle are mounted upon said more than one plane of said platform such that some of said wheels are normally in contact with said surface and some of said wheels are normally free of contact with said surface;

mounting means on said wheels normally free of contact with said surface for mounting said wheels upon said platform to freely swivel about said mounting means when said wheels contact said surface;

said mounting means having additional means for automatically returning said axles of said normally free wheels into general alignment with said axles of said surface contacting wheels when free of contact with said surface.

2. A skateboard, as claimed in claim 1, wherein:

said platform is formed with a centrally located first planar surface having said wheels mounted on opposite ends thereof; and said platform has extensions curved upward from said first plane on opposite sides of a line formed between said wheels mounted on opposite ends of said first plane, each of said extensions having at least one wheel mounted on said mounting means for said wheels normally free of contact with said surface.

3. A skateboard, as claimed in claim 2, wherein:

said additional means in said mounting means includes oppositely mounted magnets for repelling one another and for returning said wheels to said general alignment.

4. In a skateboard for use on a surface formed by mounting a plurality of wheels upon a platform, wherein the improvements comprises:

said platform formed from a single, integral body along an axis of symmetry with a first generally planar surface having extensions curving upward therefrom on opposite sides of said axis;

said plurality of wheels each having an axle include two wheels mounted upon said generally planar surface along said axis of symmetry in normal contact with said surface and one wheel each specially mounted upon said extensions normally free of contact with said surface having said axle of each specially mounted wheel generally perpendicular to said axis of symmetry;

mounting means for said specially mounted, normally free wheels for permitting said wheels to swivel about said mounting means when said specially mounted, normally free wheels contact said surface; and said mounting means including magnetic means for returning said axles of said specially mounted, normally free wheels to be generally perpendicular to said axis of symmetry when said specially mounted wheels are free of contact with said surface.

* * * * *